United States Patent [19]

Glish et al.

[11] Patent Number: 5,060,574

[45] Date of Patent: Oct. 29, 1991

[54] PROJECTILE BASE PLUG WITH ENHANCED DRAG-PRODUCING SEPARATION CAPABILITY

[75] Inventors: John P. Glish, Bloomington; Bernard F. Bickman, New Brighton, both of Minn.

[73] Assignee: Honeywell Inc., Minneapolis, Minn.

[21] Appl. No.: 546,828

[22] Filed: Jul. 2, 1990

[51] Int. Cl.[5] ..... F42B 12/62

[52] U.S. Cl. ..... 102/489; 102/357; 102/388; 102/393; 244/3.28

[58] Field of Search ..... 102/340, 342, 351, 357, 102/393, 489, 505, 386, 388; 244/3.27, 3.28, 3.3

[56] References Cited

U.S. PATENT DOCUMENTS

| | | | |
|---|---|---|---|
| 2,465,401 | 3/1949 | Skinner | 244/3.27 |
| 3,004,489 | 10/1961 | Griffith et al. | 244/3.27 |
| 3,768,755 | 10/1973 | Prochnow et al. | 244/3.27 |
| 4,648,321 | 3/1987 | Lusk | 102/388 |
| 4,854,241 | 8/1989 | Synofzik et al. | 102/489 |

FOREIGN PATENT DOCUMENTS

| | | | |
|---|---|---|---|
| 2839591 | 3/1980 | Fed. Rep. of Germany | 244/3.28 |
| 496912 | 11/1919 | France | 244/3.27 |
| 1188651 | of 1910 | United Kingdom | 244/3.27 |

*Primary Examiner*—Harold J. Tudor
*Attorney, Agent, or Firm*—Jane H. Arrett

[57] ABSTRACT

A projectile base plug with enhanced separation capability has a body which fits into an end of a spinning projectile casing and drag-producing vanes being spaced apart about the circumference of the object and pivotally mounted thereto for movement between stowed and deployed positions. Upon ejection of the base plug from the projectile casing, the vanes are released from stowed positions within the aerodynamic outline of the base plug where they have no substantial effect on the flight of the projectile, to deployed positions by centrifugal force generated by the spinning body where they project into the air stream and produce drag on the ejected base plug.

9 Claims, 4 Drawing Sheets

PROJECTILE BASE PLUG WITH ENHANCED DRAG-PRODUCING SEPARATION CAPABILITY

BACKGROUND OF THE INVENTION

1. Field-of the Invention

The present invention generally relates to ejection of cargo from projectiles and, more particularly, is concerned with a projectile base plug having enhanced drag-producing separation capability to assure the ejected base plug moves away from the ejected cargo and also prevents mid-air collisions therebetween.

2. Description of the Prior Art

Cargo such as submunitions, mines and canisters are typically delivered to a target zone by projectiles spinning and travelling along a ballistic trajectory path. In the usual sequence of operations, an explosive charge placed in a cylindrical carrier of the projectile in front of the cargo therein is ignited by a time-of-flight fuze when the projectile reaches a desired point along its trajectory path above the target zone. The gas pressure generated by ignition of the charge pushes rearwardly against the cargo to dislodge and eject a projectile base plug from the rear end of the carrier and eject the cargo from the projectile.

Mid-air collisions between the base plug and cargo expelled from the projectile can cause damage to the cargo. These collisions are due to close proximity between the ejected base plug and cargo. When the diameter of the cargo is comparable to that of the base plug, aerodynamic effects act to keep the ejected base plug in the wake of the cargo, thus preventing drag forces from moving the spinning and wobbling base plug away from the cargo. In some cases, the base plug fits over the cargo and a positive separation force between base and cargo is necessary.

Current arrangements to enhance base plug separation use spin axis transfer or an unbalanced split base plug to cause base plug travel perpendicular to the flight path of the cargo. Several problems exist with these approaches. One problem is that the flight path of the projectile can be disturbed at the critical moment of ejection. Another problem concerns safety at the test range since the unpredictable cross-range trajectory of the base plug severely limits the choice of camera locations at the ejection site.

Consequently, a need exists for a different approach to produce base plug separation from the cargo which avoids the aforementioned problems.

SUMMARY OF THE INVENTION

The present invention provides a projectile base plug with enhanced capability of separation designed to satisfy the aforementioned needs. The base plug includes a body and one or more drag-producing elements mounted thereon for movement between stowed and deployed positions wherein the drag-producing elements respectively unaffect and increasingly affect the drag characteristics of the base plug. The drag-producing elements are released upon ejection of the body of the base plug from an end of the casing of the projectile. The elements affect the drag characteristics of the base plug by increasing its frontal area to a value much larger than that of the cargo. Such increased frontal area of the base plug provides separation of the base plug from the cargo by the generation of large drag forces acting on the base plug.

Prior to cargo and base plug ejection, the drag-producing elements in the form of pivotally mounted vanes are disposed in stowed positions within the aerodynamic outline of the base plug where they do not effect the flight of the projectile. Upon cargo and base plug ejection, the drag-producing elements are released and automatically deployed into the air stream by centrifugal force generated by the spinning projectile. The body includes an annular member which mounts the drag-producing elements for pivotal movement from the stowed to deployed positions about axes extending either parallel or perpendicular to the longitudinal axis of the projectile.

Accordingly, the present invention relates to a projectile base plug with enhanced drag-producing separation capability. The enhanced base plug comprises: (a) a body attachable to an end of a casing of a spinning projectile and being capable of ejection from the casing end during flight of the projectile; and (b) at least one drag-producing element mounted to the body and being movable between stowed and deployed positions relative to the body, the element upon ejection of the body from the projectile casing being movable from the stowed to deployed position as a result of centrifugal force imposed on the element by continued rotation of the body after ejection from the spinning projectile. The enhanced base plug also includes means defining at least one recess in the body having a configuration for nesting and confining the drag-producing element within an aerodynamic profile of the body where it unaffects the flight of the projectile when the element is disposed at its stowed position. The drag-producing element extends from the recess in the body and beyond the aerodynamic profile thereof where it increases drag forces on the body and produces enhanced drag separation of the body from the projectile when the element is disposed at its deployed position.

More particularly, the body of the base plug includes tandemly-arranged inner and outer members, one member having the recess defined therein and the other member movably mounting the drag-producing element. Also, the one body member having the recess defined therein fits into the end of the casing of the projectile such that the casing end will overlie at least a portion of the drag-producing element when the element is at its stowed position. Further, the other body member is attached to the one body member and includes means mounting the drag-producing element for pivotal movement between the stowed and deployed positions.

Furthermore, the base plug preferably has a plurality of the drag-producing elements in the form of vanes being spaced apart from one another and mounted to the body about a common circumferential line on the body. Additionally, two different embodiments of the base plug are disclosed. In one embodiment, the vanes are mounted for pivotal movement about axes extending generally parallel to a longitudinal axis of the projectile, whereas in another embodiment, the pivotal axes extend generally perpendicular to longitudinal axis of the projectile.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
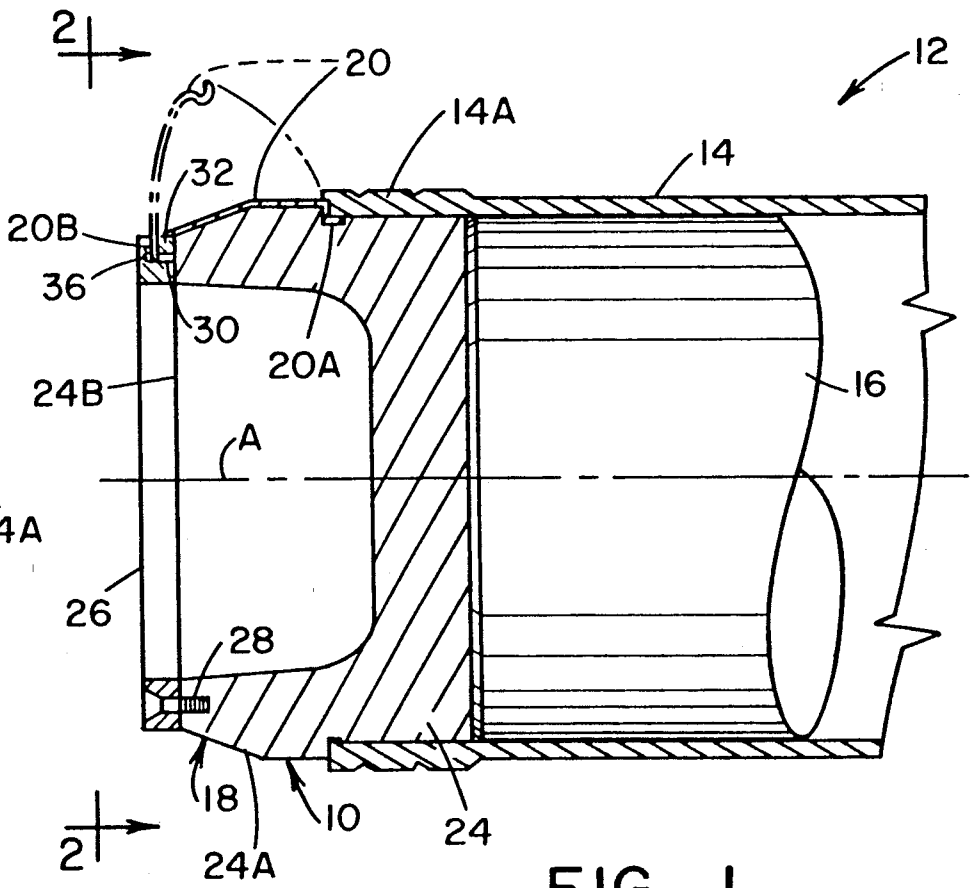
FIG. 1 is a fragmentary longitudinal axial sectional view of a rear portion of a projectile incorporating one embodiment of a base plug with enhanced separation capability in accordance with the present invention.
Figure 2:
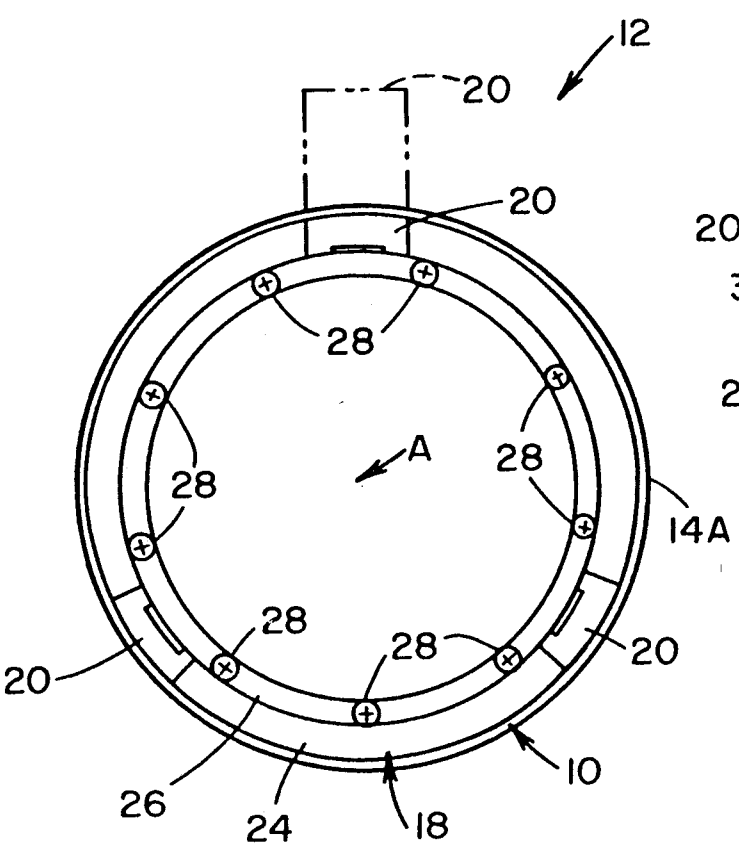
FIG. 2 is a rear elevational view of the base plug as seen along line 2—2 of FIG. 1.
Figure 3:
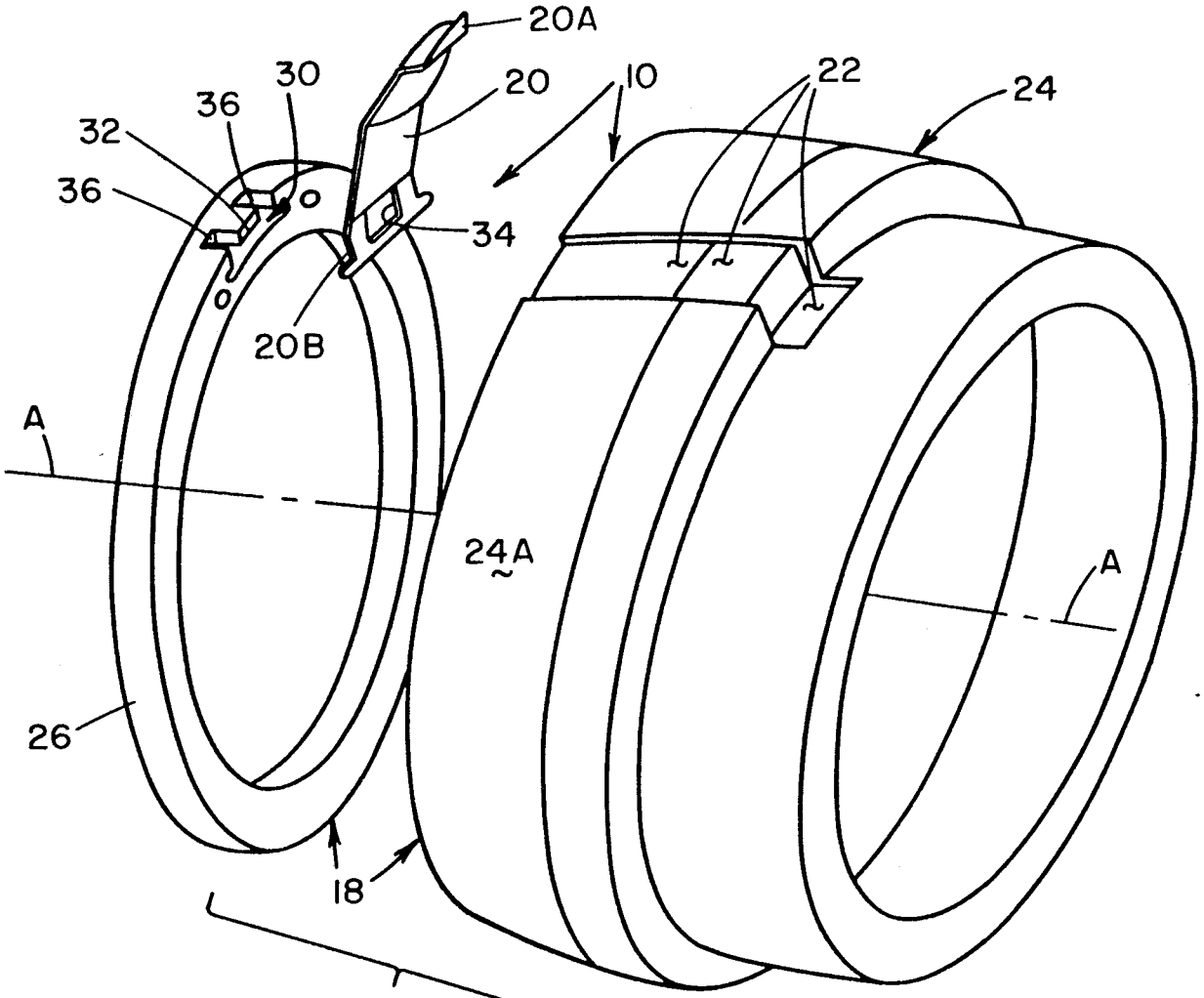
FIG. 3 is an enlarged isometric exploded view of the base plug of the projectile of FIG. 1.

Referring to the drawings, and particularly to FIGS. 1-3, there is shown one preferred embodiment of a projectile base plug 10 with enhanced separation capability in accordance with the principles of the present invention. The enhanced separation base plug 10 is used by a projectile 12 being of the type which spins during its flight along a path of ballistic trajectory toward a target zone. In addition to the enhanced base plug 10 of the present invention, the projectile 12 includes a hollow cylindrical carrier or casing 14 for housing a cargo 16 therein, such as submunitions, mines and canisters, for delivery to the target zone. The enhanced separation base plug 10 is generally cylindrical shaped and fits within a rear end 14A of the casing 14 so as to seal the same.

In its basic components, the enhanced base plug 10 includes a generally cylindrical shaped body 18 and at least one and preferably a plurality of drag-producing elements in the form of drag vanes 20 movably mounted to the body 18. The base plug body 18 fits within a rear end 14A of the casing 14 of the spinning projectile 12 so as to seal the same. The body 18 is attached to the casing end 14A so as to be capable of ejection therefrom upon ejection of the cargo 16 during flight of the spinning projectile 12. The drag vanes 20 are spaced apart from one another and pivotally mounted to the base plug body about a common circumferential line thereon. The number of vanes 20 can be varied to suit the particular application.

In such arrangement, the drag vanes 20 are movable relative to the base plug body 18 between a stowed position, as seen in solid line form in FIGS. 1 and 2, and a deployed position, as seen in dashed line form in FIGS. 1 and 2. Upon ejection of the base plug body 18 from the projectile casing 14, the drag vanes 20 will automatically move from the stowed to deployed positions as a result of centrifugal force imposed on the vanes by continued rotation of the ejected body 18 after ejection from the spinning projectile 12.

Figure 4:
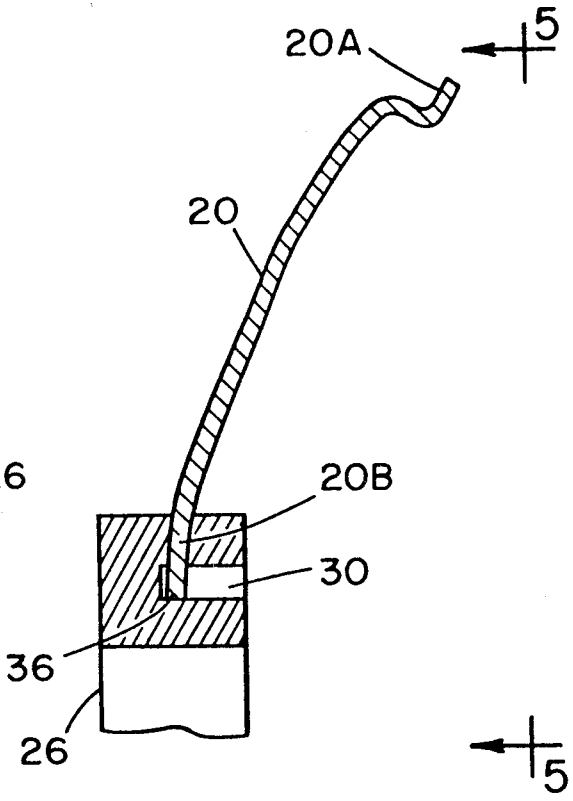
FIG. 4 is a fragmentary sectional view taken along line 4—4 of FIG. 5 after a drag-producing element is assembled to a body of the base plug.
Figure 5:
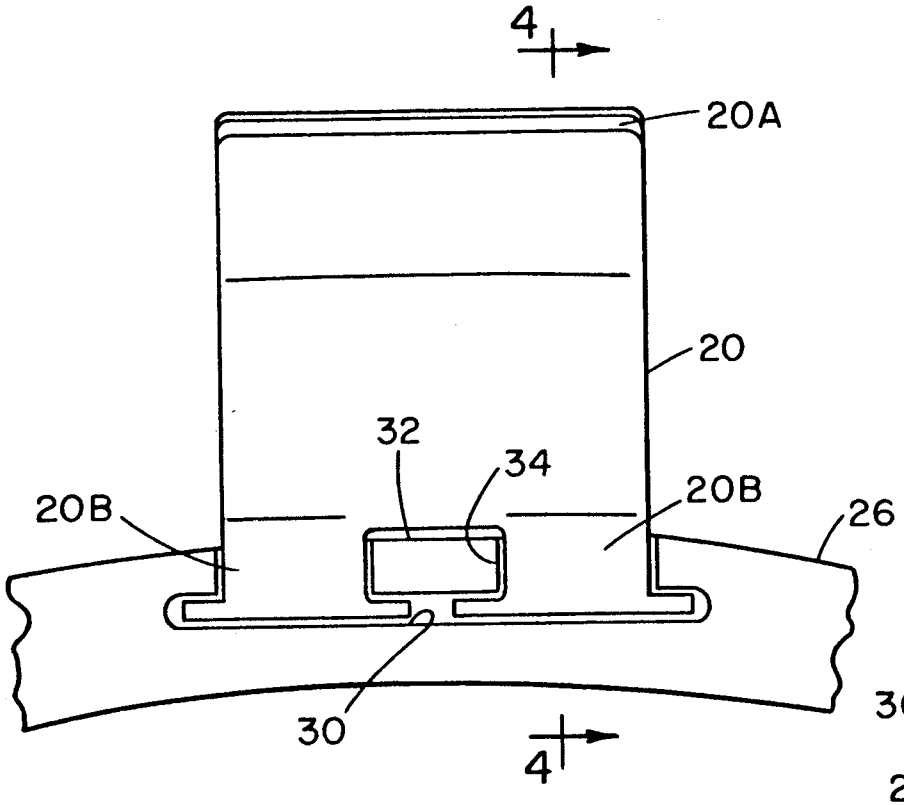
FIG. 5 is a front elevational view as seen along line 5—5 of FIG. 4.

Referring also to FIGS. 3-5, the enhanced base plug 10 of the present invention also includes a plurality of recesses 22 defined in the body 18 in the same circumferentially spaced apart relationship with respect to one another as that of the vanes 20. The recesses 22 in the body 18 have identical configurations for nesting and confining the identical drag vanes 20 when at their stowed position within the external aerodynamic profile of the body 18 where they will not affect the flight of the spinning projectile 12. Then, when the vanes 20 pivot to their deployed position, they extend from the respective recesses 22 in the base plug body 18 to beyond the aerodynamic profile thereof and thereby increase drag forces on the ejected body 18 which produces enhanced drag separation of the body from the cargo 16. Alternatively, the recesses 22 can merely be spaced portions of a common circumferential undercut in the body 18.

More particularly, the base plug body 18 includes tandemly-arranged inner (or forward) and outer (or rearward) members 24 and 26. The inner body member 24 is a cylindrical base plug member 24 which fits into the rear end 14A of the casing 14 of the projectile 12. The recesses 22 are defined in spaced apart relation on the peripheral surface 24A of the inner base plug member 24. When the vanes 20 are disposed at their stowed position nested within the recesses 22, the rear end 14A of the casing 14 overlies outer flange portions 20A on the respective vanes 20.

The outer body member 26 is an annular support ring member 26 attached by fasteners such as screws 28 to an outer end surface 24B of the inner base plug member 24. The annular support member 26 movably mounts the drag vanes 20. More particularly, the annular support member 24 has means in the form of forwardly-facing and circumferentially-spaced cutouts 30 (only one being shown in FIG. 3) defining lugs 32 which receive and mount the vanes 20 at inner hinge portions 20B thereof. The lugs 32 extend through holes 34 in the hinge portions 20B of the vanes and the cutouts 30 have inner shoulders 36 which define the limit of pivotal movement of the vanes 20 to their deployed position. The cutouts 30 in the support member 24 and hinge portions 20B define pivotal movement of the vanes 20 about axes extending substantially perpendicular to a longitudinal axis A of the projectile 12.

Figure 6:
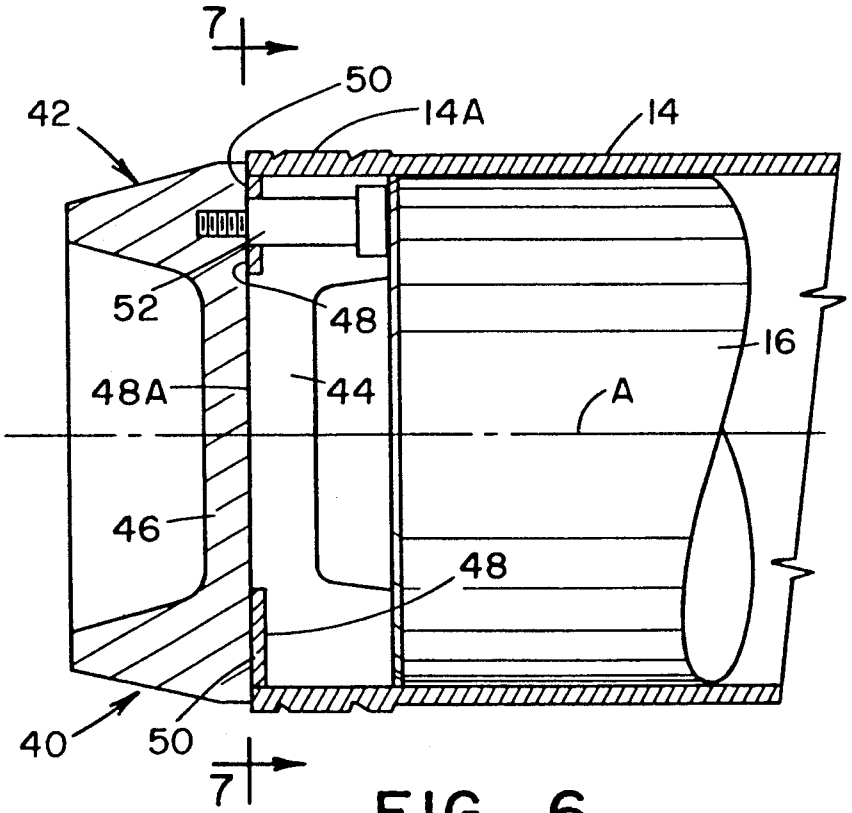
FIG. 6 is a fragmentary longitudinal axial sectional view of the rear portion of the projectile incorporating another, embodiment of the base plug of the present invention.
Figure 7:
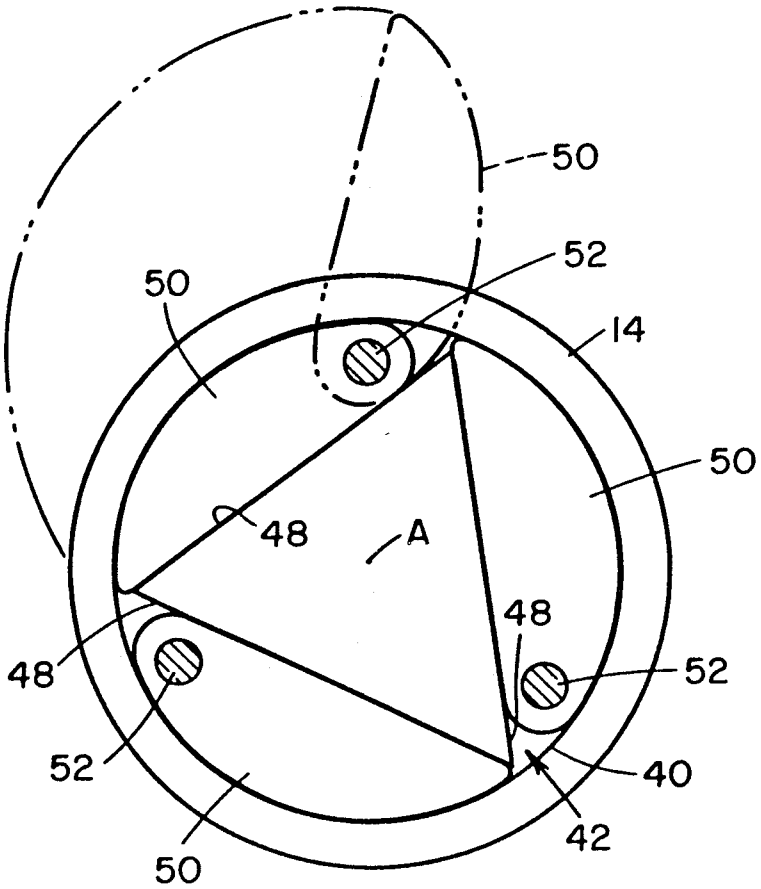
FIG. 7 is a cross-sectional view of the projectile taken along line 7—7 of FIG. 6.

Referring to FIGS. 6 and 7, there is illustrated a second preferred embodiment of the enhanced base plug, generally designated 40 and constructed in accordance with the present invention. Similar to the base plug 10 of the first embodiment, the base plug 40 of the second embodiment has a body 42 composed of tandemly-arranged inner and outer members 44 and 46. However, in contrast to the base plug 10 of the first embodiment of FIGS. 1-5, in the base plug 40 the inner member 44 is a spacer or support member 44 fitted into the casing end 14A and has a plurality of recesses 48 defined on an outer end surface 48A thereof. The inner support member 44 and a plurality of vanes 50 disposed in the recesses 48 are attached to the outer member 46 in the form of the base plug member 46 by circumferentially spaced fasteners 52. When the vanes 50 are pivoted to their stowed position, the casing end 14A overlies them, preventing their inadvertent release. In this second embodiment, the vanes 50 are mounted by the fasteners 52 for pivotal movement between the stowed and deployed positions about axes extending substantially parallel to the longitudinal axis A of the projectile 12.

In the usual sequence of operation of the spinning projectile 12, an explosive charge (not shown) placed in the casing 14 of the projectile 12 in front of the cargo 16 is ignited by a time-of-flight fuze (not shown) when the projectile 12 reaches a desired point along its trajectory path above the target zone. The gas pressure generated by ignition of the charge pushes rearwardly against the cargo 16 to dislodge and eject the enhanced base plug 19 from the rear end 14A of the casing 14 and eject the cargo 16 from the projectile. Damage due to mid-air collisions between the ejected base plug 10 and cargo 16 due to their close proximity to one another are now avoided since the diameter of the ejected base plug 10 is no longer comparable to that of the cargo 16 and thus aerodynamic effects do not act to keep the ejected base plug 10 in the wake of the cargo 16. Instead, the drag-producing vanes 20, which automatically unlatch and release from under the rear end 14A cf the casing 14 at base plug and cargo ejection, pivot to their deployed position due to centrifugal force imposed thereon by the spinning plug body 18 and increase the frontal area of the body 18 facing the air stream to a value much larger than that of the cargo 16. Such increased frontal area of the base plug body 18 provides separation of the enhanced base plug 10 from the cargo 16 by the generation of large drag forces acting on the enhanced base plug 10. The drag force at Mach 1.0 is expected to develop a separation of two diameters in fifty milliseconds.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. In combination with a projectile having a longitudinal axis and being capable of spinning during travel along a path of flight and having an outer tubular casing for housing an object being ejectable from a hollow rear end of the projectile casing, a base plug with enhanced drag-producing separation capability, comprising:

(a) a body detachably attached at a forward portion within a hollow rear end of an outer tubular casing of a spinning projectile and at a rearward portion projecting rearwardly from said casing rear end, said body being capable of ejection from the casing rear end during flight of the projectile;

(b) at least one drag-producing vane having forward and rearward ends, said vane at its rearward end being mounted to said rearward portion of said body for movement about an axis extending substantially perpendicular to a longitudinal axis of the projectile between stowed and deployed positions relative to said body, said vane before ejection of said body from said casing rear end being encompassed at its forward end by said casing rear end so as to prevent pivoting of said vane from the stowed to deployed positions, said vane upon ejection of said body from the projectile casing being movable form the stowed to deployed position as a result of centrifugal force imposed on said vane by continued rotation of said ejected body after ejection from the spinning projectile; and (c) means defining at least one recess in an outer peripheral surface of said rearward portion of said body, said recess having a configuration for nesting and confining said drag-producing vane within an aerodynamic profile of said body where it unaffects the flight of the projectile when said vane is disposed at its stowed position, said vane extending from said recess in said body and beyond teh aerodynamic profile thereof where it increases drag forces on said body from the projectile when said vane is disposed at its deployed position.

2. The projectile base plug of claim 1 wherein said body includes a base plug member attached to the rear end of the casing of the projectile and having said recess defined on an outer peripheral surface of said base plug member such that the casing rear end will overlie said forward end of said drag-producing vane when said vane is at its stowed position.

3. The projectile base plug of claim 2 wherein said body further includes an annular support member attached to a rear end of said base plug member and pivotally mounting said drag-producing vane at its rearward end.

4. In combination with a projectile having a longitudinal axis and being capable of spinning during travel along a path of flight and having an outer tubular casing for housing an object being ejectable from a hollow rear end of the projectile casing, a base plug with enhanced drag-producing separation capability, comprising:

(a) a body detachably attached at a forward portion within said hollow rear end of said tubular casing of said spinning projectile and at a rearward portion projecting rearwardly from said casing rear end, said body being capable of ejection from said casing rear end upon ejection of the object during flight of said projectile;

(b) at least one drag-producing element having forward and rearward end, said element at its rearward end being mounted to an outer peripheral surface of said rearward portion of said body for movement about an axis extending substantially perpendicular to a longitudinal axis of the projectile between stowed and deployed positions relative to said body, said element before ejection of said body from said casing rear end being encompassed at its forward end by said casing rear end so as to prevent pivoting of said element from the stowed to deployed positions, said element upon ejection of said body from the projectile casing being movable from the stowed to deployed position as a result of centrifugal force imposed on said element by continued rotation of said ejected body after ejection from said spinning projective.

5. The base plug of claim 4 further comprising:

(c) means defining at least one recess in said outer peripheral surface of said rearward portions of said body, said recess having a configuration for nesting and confining said drag-producing element within an aerodynamic profile of said body where it unaffects the flight of the projectile when said element is disposed at its stowed position, said element extending from said recess in said body and beyond the aerodynamic profile thereof where it increases drag forces on said body and produces enhanced drag separation of said body from the object ejected from said projectile with said body when said element is disposed at its deployed position.

6. The projectile base plug of claim 5 wherein said body includes a base plug member attached to said rear end of said casing of said projectile and having said recess defined on an outer peripheral surface of said base plug member such that said casing rear end will overlie said forward end of said drag-producing element when said element is at its stowed position.

7. The projectile base plug of claim 1 wherein said body further includes an annular support member attached to a rear end of said base plug member and pivotally mounting said drag-producing element at its rearward end.

8. The base plug of claim 4 further comprising a plurality of said drag-producing elements, said elements being spaced apart from one another and mounted to said body about a common circumferential line on said body.

9. The base plug of claim 8 wherein said drag-producing elements are vanes.

* * * * *

UNITED STATES PATENT AND TRADEMARK OFFICE

CERTIFICATE OF CORRECTION

PATENT NO. : 5,060,574

DATED : October 29, 1991

INVENTOR(S) : John P. Glish et al.

It is certified that error appears in the above-identified patent and that said Letters Patent is hereby corrected as shown below:

Column 5, line 62, cancel "form" and substitute --from--.

Column 6, line 35, cancel "end" and substitute --ends--.

Signed and Sealed this

Second Day of March, 1993

*Attest:*

STEPHEN G. KUNIN

*Attesting Officer*

*Acting Commissioner of Patents and Trademarks*